US009704349B1

(12) United States Patent
Kerr

(10) Patent No.: US 9,704,349 B1
(45) Date of Patent: Jul. 11, 2017

(54) NETWORKED RANDOMIZED EXCHANGES WITH ADJUSTMENT FOR NON-OPTIMAL TRANSACTIONS

(71) Applicant: Monty Kerr, Houston, TX (US)

(72) Inventor: Monty Kerr, Houston, TX (US)

(73) Assignee: Playstudios, Inc., Las Vegas, NV (US)

( * ) Notice: Subject to any disclaimer, the term of this patent is extended or adjusted under 35 U.S.C. 154(b) by 134 days.

(21) Appl. No.: 14/492,120

(22) Filed: Sep. 22, 2014

(51) Int. Cl.
*G07F 17/32* (2006.01)

(52) U.S. Cl.
CPC ..... *G07F 17/3293* (2013.01); *G07F 17/3244* (2013.01)

(58) Field of Classification Search
USPC ..... 463/12, 13
See application file for complete search history.

(56) References Cited

U.S. PATENT DOCUMENTS

2014/0370958 A1* 12/2014 Lutnick ..... G07F 17/3276 463/17
2016/0203675 A1* 7/2016 Lutnick ..... G07F 17/3232 463/16
2017/0039814 A1* 2/2017 Trepp ..... G07F 17/3293

* cited by examiner

*Primary Examiner* — Pierre E Elisca
(74) *Attorney, Agent, or Firm* — Muskin & Farmer LLC

(57) ABSTRACT

A method, apparatus, and computer readable storage to implement a networked entertainment system. A game such as blackjack can be offered to multiple (e.g. 10 or more) simultaneous players. The game has decision points in which each player makes a strategic decision. For those situations where players make the mathematically incorrect decision, the significance of the error can be computed as a decrease in expected value of the award that the player would have won. This error can then be returned back to the player immediately or accumulated and returned at a later time.

20 Claims, 9 Drawing Sheets

NETWORKED RANDOMIZED EXCHANGES WITH ADJUSTMENT FOR NON-OPTIMAL TRANSACTIONS

BACKGROUND OF THE INVENTION

Field of the Invention

The present general inventive concept is directed to a method, apparatus, and computer readable storage medium directed to a networked entertainment system with randomized transactions with adjustments for non-optimal transactions.

Brief Description of the Prior Art

The casino game of blackjack is well known, for example see U.S. Patent publication 2003/0155715 which is incorporated by reference herein in its entirety.

FIG. 1 is a flowchart illustrating a method of implementing the known game of blackjack.

Points totals are computed by adding the standard rank value of each card, with face valued cards (tens, jacks, queens, kings) being given a value of 10, and aces being given a value of 1 or 11, whichever results in a better hand. A soft point total is where at least one ace is given the value of 11. A hard point total is a hand with all aces counting as 1.

In operation 100, the player makes a main wager by placing chips on a table. Then, in operation 102, the dealer deals two initial cards to each player (either face up or face down) and two initial cards to the dealer, typically one face down ("hole-card"), and one face up (the "up-card"). Then the player can decide whether to hit, stand, double, or split. If the player decides to hit, then the method proceeds to operation 106, which deals an additional card to a player. If a determination 108 determines that the player has busted (the player's hard point total is over 21), then the player loses the game and thus loses the main wager in operation 110, which ends the game. If the determination 108 determines that the player has not busted, then the method returns to operation 104, where the player can make another decision whether to hit or stand. In operation 104, the player can also double (not pictured) by place an additional wager of up to the main wager, but the player is limited to drawing only one additional card before the player must stand.

If the player stands and has not busted out (either stands on his or her initial two cards or draws cards but has a point total under 22 and then stands), then the method proceeds to operation 112, which reveals all dealer's cards (e.g., turns the hole-card face up) and which then plays out the dealer's hand according to predetermined rules. In operation 114, if the dealer's total is greater than a predetermined amount (typically 17), then the dealer stands (proceeds to operation 122). If the dealer's total is not greater than the predetermined amount, the method proceeds to operation 116 which deals an additional card to the dealer. If it is then determined 118 that the dealer has not busted (has a point total over 21), the method returns to operation 114. If the dealer has busted, then the player wins the game and the main wager in operation 120 (this assumes the player has not also busted; if the player has already busted then the player would have lost in operation 110).

In operation 122, both the player and the dealer have played out their hand and neither have busted. Thus, their respective point totals (adding the numerical values of each card in the hand) are compared. If the dealer's point total is determined in operation 124 to be lower than the player's point total, then the player wins the game and the main wager in operation 120. Otherwise, if the dealer's point total is determined 128 to be greater than the player's point total, then the player loses the game and the main wager in operation 130. If the player's point total ties the dealer's point total, then that results in a "push" in operation 126 in which the player doesn't win or lose the main wager (the main wager bet is a wash).

If a player is initially dealt two identically ranked cards in operation 102, players can also split in operation 104 by placing an additional split wager equal in value to the main wager, and the player's two initial cards are separated and the dealer deals an additional card on each. The player then plays out each of the two separate hands, each from operation 104. Depending on house rules, players may or may not be allowed to resplit cards.

SUMMARY OF THE INVENTION

It is an aspect of the present invention to provide a mechanism to compensate players for errors made during a game involving strategic decision points.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
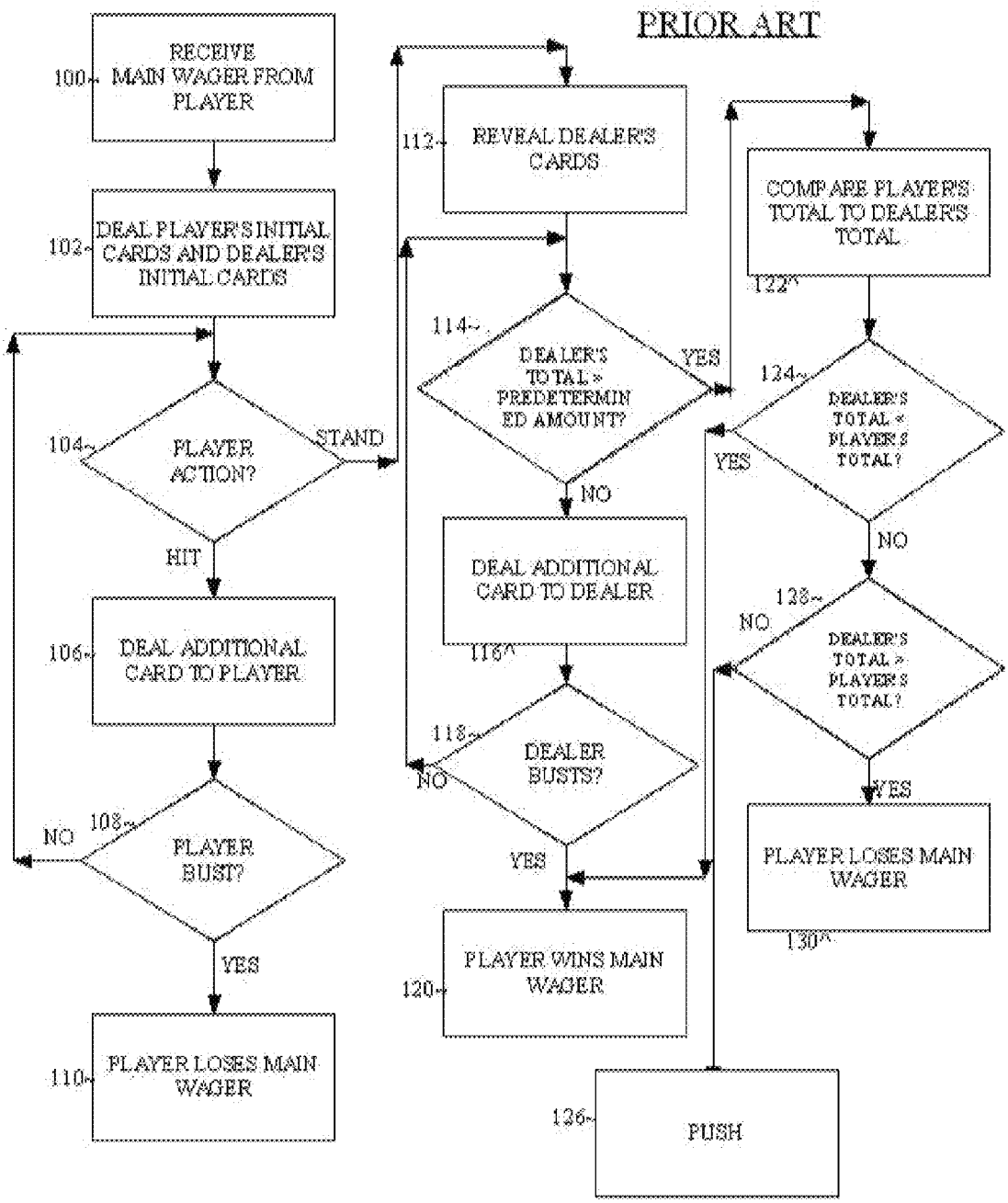
FIG. 1 is a flowchart illustrating a method of implementing the known game of blackjack.

Reference will now be made in detail to the presently preferred embodiments of the invention, examples of which are illustrated in the accompanying drawings, wherein like reference numerals refer to like elements throughout.

The present inventive concept relates to combining experiences on physical electronic gaming devices found in casinos (e.g., slot machines) with games that can be played online. Online games can include games played on a social networking site such as FACEBOOK (including what is described in U.S. Pat. No. 7,669,123 which is incorporated by reference herein in its entirety), MYSPACE, or any other site which maintains a database of users and provides an interface for interaction.

Players can earn a loyalty points (also referred to herein as secondary currency or virtual points) by playing online (using a computer using the internet to play an online game such as one on FACEBOOK). Loyalty points typically have no cash value. The online game can be an online casino or any other game. The secondary currency/loyalty points can be earned as described herein. Loyalty points can be redeemed for tangible goods. For example, a list of tangible items (e.g., free room at a particular hotel, show tickets for a particular show, deck of playing cards, etc.) can all be displayed alongside a cost in loyalty points, and the player can choose which item the player wishes to receive upon which the respective number of loyalty points will be deducted from the player's account (assuming the player has the required number of loyalty points) and the player will be delivered the item (electronically such as via an email/text or physically).

Figure 2:
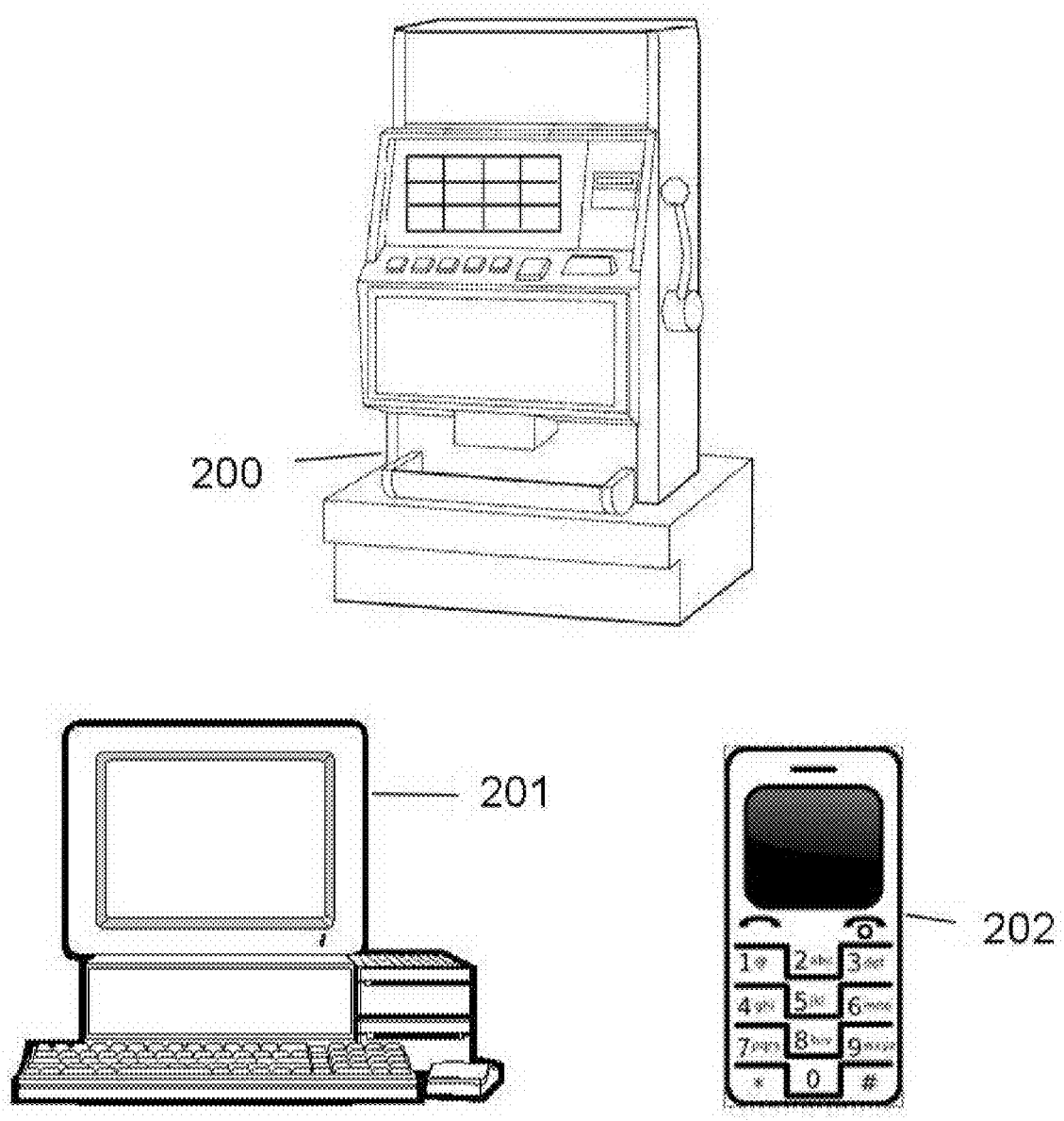
FIG. 2 is a drawing illustrating numerous apparatuses that can play the game described herein, according to an embodiment.

FIG. 2 is a drawing illustrating numerous apparatuses that can play the slot machine game described herein, according to an embodiment. Other types of games can be implemented as well (e.g., blackjack, etc.)

The game described herein can be played on an electronic gaming machine 200 that can found in brick and mortar casinos or other venues such as internet cafes, etc. Cash (or cashless vouchers) can be inserted into the machine 200 using a bill acceptor which credits the machine with a respective amount of credits which can then be used to play the game, and winnings are paid out in the form of credits which can then be cashed out for cash or a cashless voucher that can be redeemed for cash. The game described herein can exist on a software module pre-installed on the slot machine 200 or can be downloaded to the electronic gaming machine 200 from a central remote server.

The game described herein can also be played on a computer 201 such as a personal computer, laptop, etc. The game can be downloaded to the computer 101 and stored locally on the computer 201. Alternatively, the computer 201 can have an internet connection (not illustrated) so that the game can be served from a remote location and player and displayed on the computer 201. For example, the game can be played on an online casino (wherein the player can wager for real money using a credit card or other deposit method, where legal) in which the results are determined on a remote server and transmitted to the computer 201 so that the computer displays the results. The game can also be played on the computer 201 for "casual play" on a social networking site (e.g., FACEBOOK, MYSPACE, etc.) wherein the game software can be launched from within the social network site itself "Casual play" is where the game can be played not for real money but for credits which typically have no cash value, but can have other benefits to the player.

The game described herein can also be played on a cell phone 202 or any other type of portable device, such as a tablet computer, etc. The portable device can implement any of the paradigms described herein with respect to the computer 201 (e.g., online casino, social networking site, etc.).

There are numerous quantities that each player can possess which is stored in each player's respective account. These quantities comprise loyalty points and non cash value credits. In another embodiment, cash credits can also be stored when the games described herein are played for real money instead of non cash value chips.

A player can earn loyalty points in numerous ways. Loyalty points are typically earned from playing games online that are part of the entire system. For example, a player can earn loyalty points based on the amount of non-cash value credits wagered (e.g., for each 10 non-cash value credits, the player earns 1 loyalty point). Players typically cannot pay cash in order to earn loyalty points and cannot convert non cash value credits into loyalty points. Loyalty points are accumulated for each player during play and stored in each player's account. U.S. application Ser. Nos. 13/472,454 and 14/144,581 are both incorporated by reference herein in their entireties. Loyalty points can be exchanged by players for physical goods or services. For example, a list of physical goods can be displayed to the player along with their cost in loyalty points. Each player can initiate an exchange of the respective amount of loyalty for the physical goods, which can be delivered to the player via an email coupon (which the player can present the coupon at a physical location in order to pick up the good). For example, a player can exchange 100 loyalty points for a ticket to a show, or 300 loyalty points for a pair of casino dice. The products can be picked up at specialized booths at a casino. The player can present a coupon (emailed to them) which has a bar code (or number) which an attendant at the booth can scan (or enter) into their computer in order to validate the coupon and award the product.

"Cash credits" refers to credits the player may have on an electronic gaming device which can be cashed out instantly for a cashless voucher which is redeemable for cash at a ticket redemption machine or casino cashier cage. For example, a player deposits a $100 bill into a bill validator in an electronic gaming machine, he has $100 cash credits. Assuming the player plays the electronic gaming machine and wins $50, the player's credit meter reflects that he has $150 cash credits in which the player can immediately cash out at any time and redeem for cash.

Non cash value (NCV) credits (also referred to as non-cash value chips) are credits which cannot be directly converted into cash. Non cash value credits can be used to play a slot machine game, blackjack game, or any other electronic wagering game. Non cash value credits can be purchased using cash or earned by completing tasks. Some non cash value credits may be given away for free to players who meet certain conditions.

Figure 3:
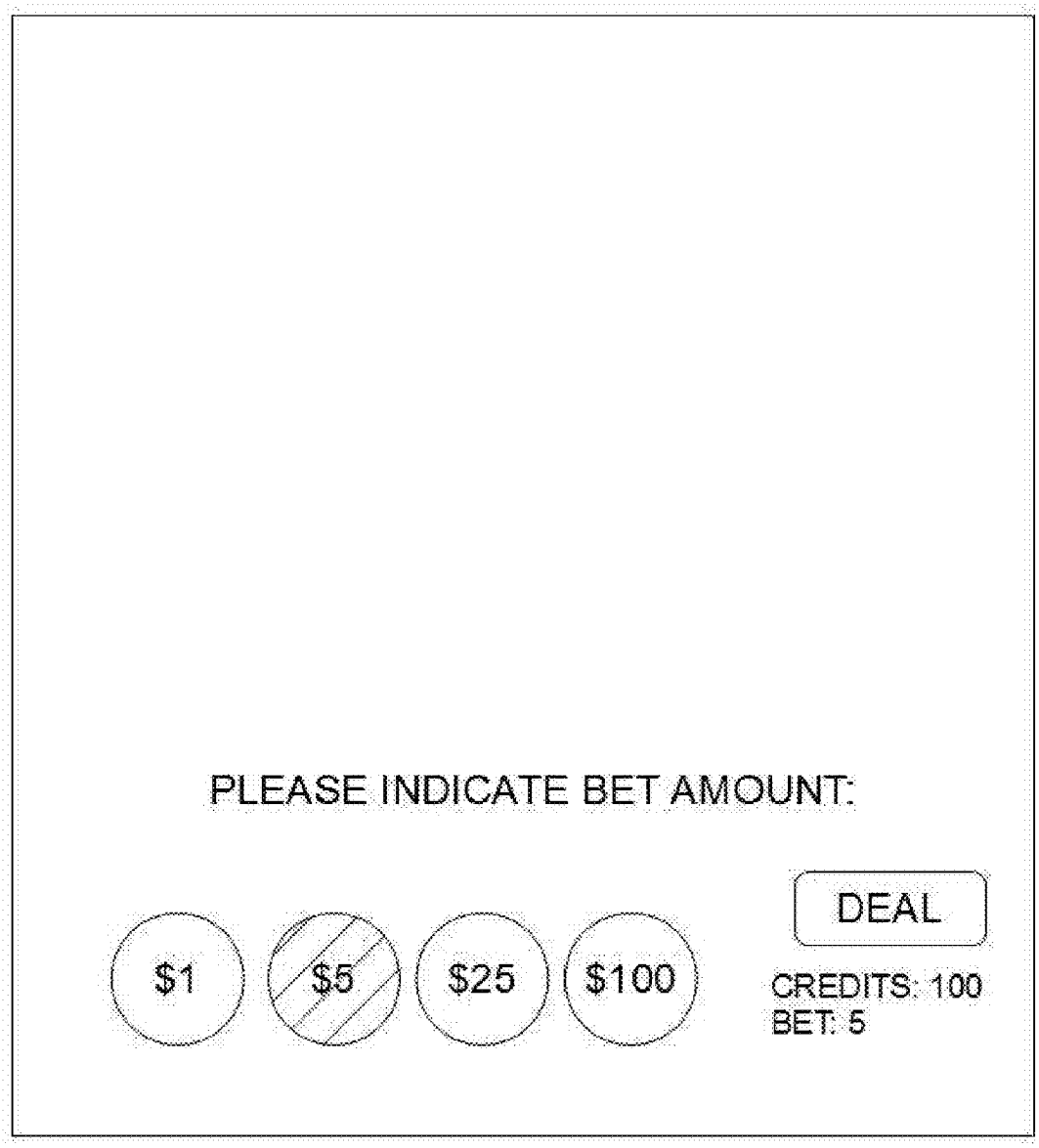
FIG. 3 is a drawing illustrating a wagering selection phase of a blackjack game that can be played online or on a physical electronic gaming machine, according to an embodiment.

FIG. 3 is a drawing illustrating a wagering selection phase of a blackjack game that can be played online or on a physical electronic gaming machine, according to an embodiment.

The player first selects how much he/she wishes to bet by selecting one (or more) chip denominations (all of which are added) to indicate the amount of credits to bet (the denominations shown are $1, $5, $25, $100 although any other denominations can be used as well). Note the credit meter (which states "credits: 95") which indicates how many non-cash value chips the player currently has. The credit meter is updated each time the player makes a bet (the credit meter is deducted by the wager amount) and wins a payout (the credit meter is increased by the payout/award amount). For example, fi the player make a 5 credit wager the credit meter is decreased by 5. If the player then wins this wager, the credit meter is increased by 10 (representing the original wager and its payout). The credits shown are non cash value chips. The player here selected to bet 5 non cash value chips. The player then presses (clicks) the deal button to begin the game (invokes FIG. 4).

Figure 4:
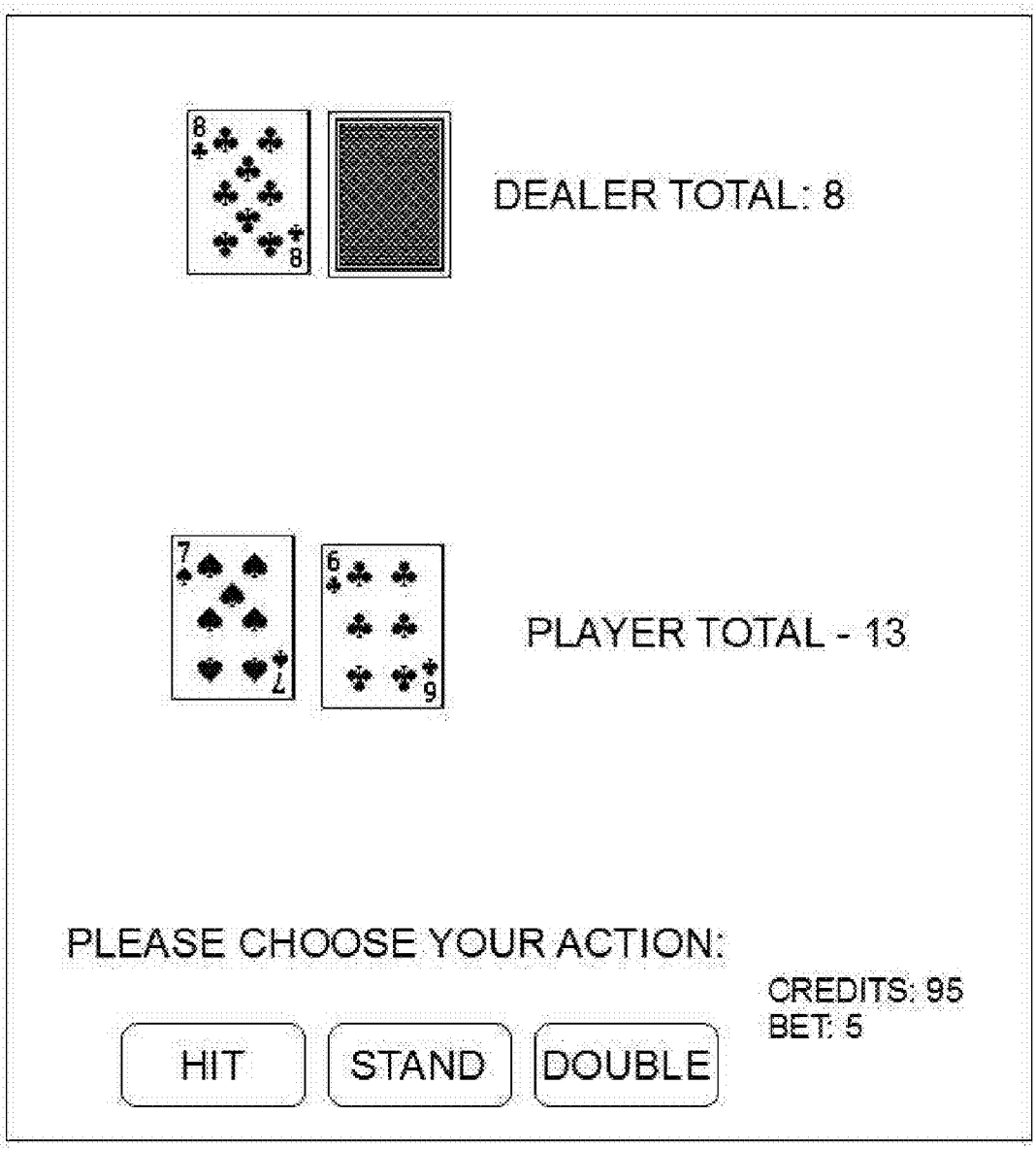
FIG. 4 is drawing illustrating a decision phase of the blackjack game, according to an embodiment.

FIG. 4 is drawing illustrating a decision phase of the blackjack game, according to an embodiment. Shown is merely one example, but it can be appreciated that cards dealt are purely random chosen by an electronic random number generator and display as images. A standard 52 card deck can be used (or any number of such decks or an infinite deck).

After the player clicks deal in FIG. 3, two random player cards are "dealt" to the player (both face up) and two random dealer cards are dealt to the dealer (one face up and a face-down hole card). The player now can make a decision whether to hit, stand, or double. The proper mathematical play is to hit, but of course the player is free to make any player he/she chooses.

Figure 5:
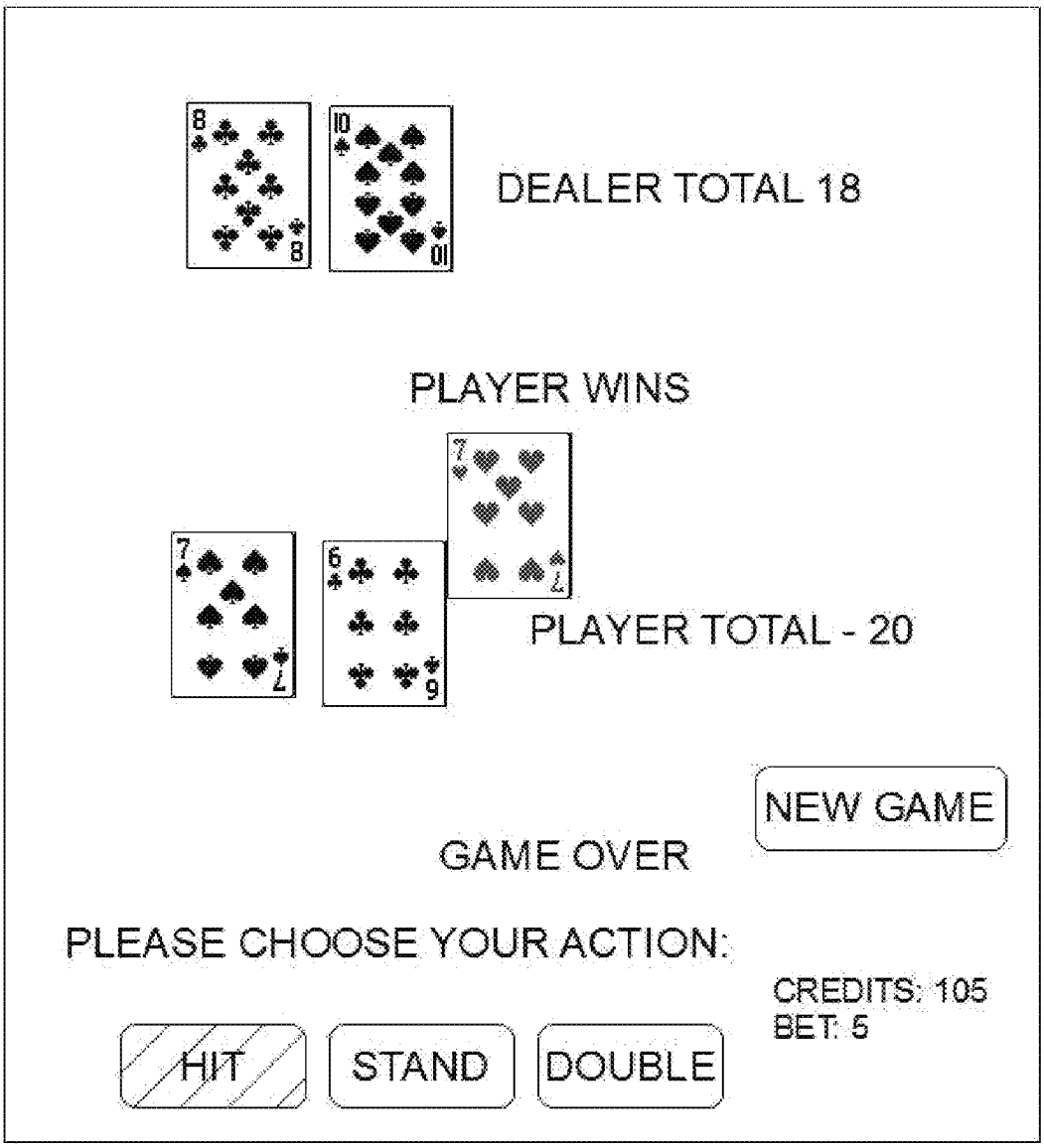
FIG. 5 is a drawing illustrating a completion of the blackjack game, according to an embodiment.

FIG. 5 is a drawing illustrating a completion of the blackjack game, according to an embodiment.

In FIG. 4, the player chose to hit (clicked the hit button) and then another card is dealt to the player in FIG. 5. In this case, a seven was dealt to the player which gives the player a point total of 20. The player now decides to stand by clicking the stand button. Then, the dealer's hole card is revealed which reveals a 10 which gives the dealer a point total of 18. Since the player's point total of 20 is higher than the dealer's point total of 18 the player wins (and the player's credit meter is now increased to 105). The game is over and a new game can begin (by the player clicking the new game button).

Figure 6:
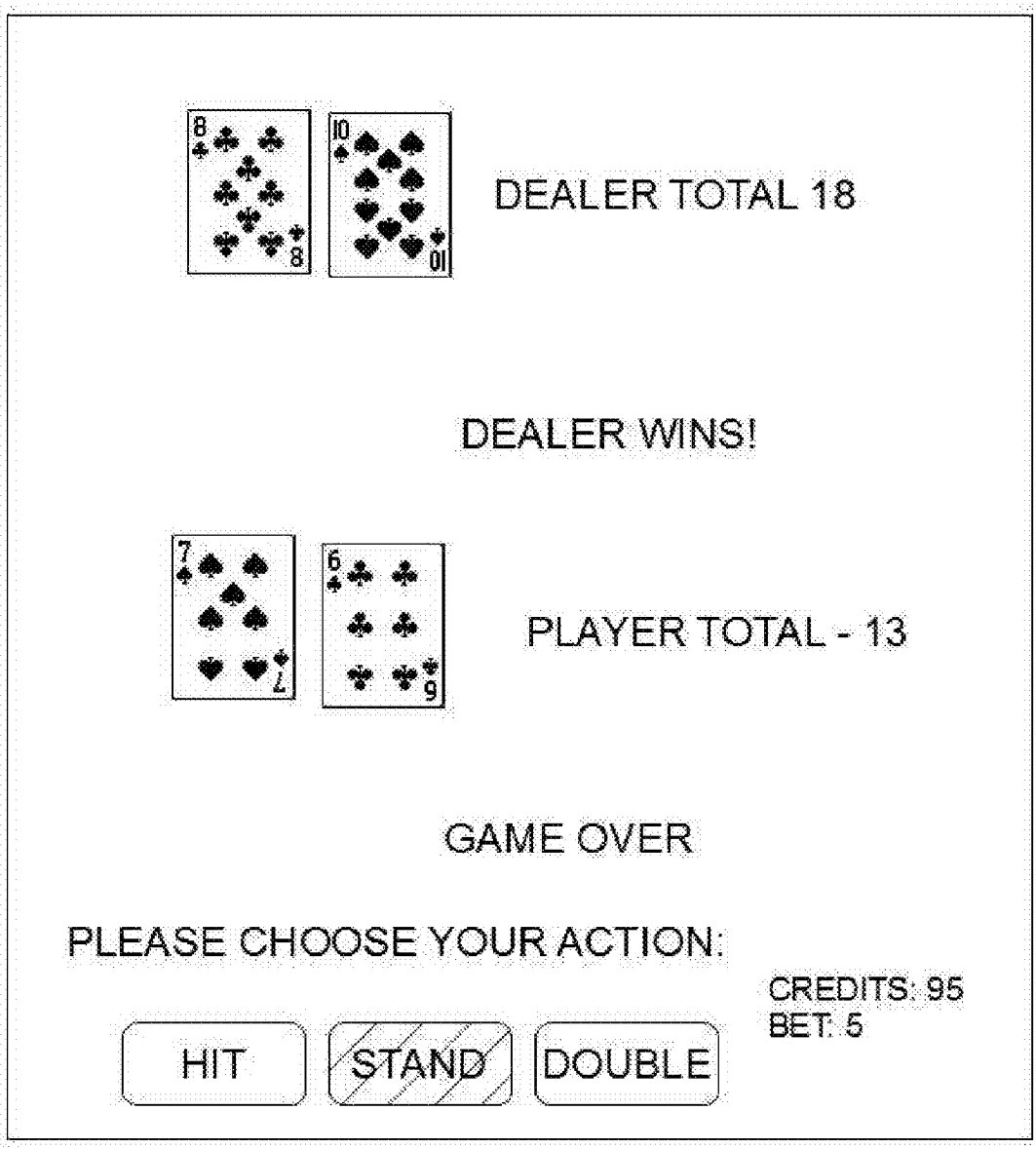
FIG. 6 is a drawing illustrating an alternative completion of the blackjack game using a different player decision, according to an embodiment.

FIG. 6 is a drawing illustrating an alternative completion of the blackjack game using a different player decision, according to an embodiment. FIG. 6 is an alternative outcome to FIG. 5 in which the player chose to play a different strategy.

In FIG. 4, the player chose to click the stand button (as opposed to FIG. 5 where the player clicked the hit button), and so in FIG. 6 the dealer's hole card is revealed to be a ten. The dealer has a point total of 18 and the player has a point total of 13. Thus, the player loses (since the dealer has a higher point total without busting) and the player loses the 5 credit wager. Note that here the player made the mathematically incorrect play.

In the case of FIG. 6, the player can be compensated for the amount of expected value that the player gave up by making this wrong play. The expected value of this play (standing) can be subtracted from the expected value of the proper play (hitting) to determine the expected value that was lost which can be multiplied by the wager size to determine the theoretical cost of the player's mistake. Since the cards dealt are all random, it is possible that the game could possibly turn out better for the player even though the player made a mistake. However, in the long run, the actual cost of such mistakes will approach their theoretical cost.

Table I below is a table showing the player expected returns for standing on each possible point total. For example, if the player bets $100 and is dealt a 17 and the dealer's up-card is 6, in the long run the player will win $1.17 (one dollar 17 cents). Thus, the player's expected return is a profit of 0.011739 multiplied by the bet amount.

TABLE I

Player's Expected Return by Standing

| PLAYER'S | DEALER'S UP CARD | | | | |
|---|---|---|---|---|---|
| HAND | 2 | 3 | 4 | 5 | 6 |
| 0-16 | −0.292784 | −0.252250 | −0.211063 | −0.167193 | −0.153699 |
| 17 | −0.152975 | −0.117216 | −0.080573 | −0.044941 | 0.011739 |
| 18 | 0.121742 | 0.148300 | 0.175854 | 0.199561 | 0.283444 |
| 19 | 0.386305 | 0.404363 | 0.423179 | 0.439512 | 0.495977 |
| 20 | 0.639987 | 0.650272 | 0.661050 | 0.670360 | 0.703959 |
| 21 | 0.882007 | 0.885300 | 0.888767 | 0.891754 | 0.902837 |

TABLE I-continued

| Player's Expected Return by Standing | | | | | |
|---|---|---|---|---|---|
| PLAYER'S | DEALER'S UP CARD | | | | |
| HAND | 7 | 8 | 9 | 10 | ACE |
| 0-16 | −0.475375 | −0.510518 | −0.543150 | −0.540430 | −0.666951 |
| 17 | −0.106809 | −0.381951 | −0.423154 | −0.419721 | −0.478033 |
| 18 | 0.399554 | 0.105951 | −0.183163 | −0.178301 | −0.100199 |
| 19 | 0.615976 | 0.593854 | 0.287597 | 0.063118 | 0.277636 |
| 20 | 0.773227 | 0.791815 | 0.758357 | 0.554538 | 0.655470 |
| 21 | 0.925926 | 0.930605 | 0.939176 | 0.962624 | 0.922194 |

Table II below is a table showing the player expected returns for hitting on each possible point total. Note that if the player has 17 and the dealer's up-card is a six, then by hitting the player's expected return is −0.5088. In other words, for a $100 bet the player will be expected to lose $50.88. Comparing the loss of $50.88 by hitting to the profit of $1.17 by standing, the correct play in this situation is to stand. The error of hitting would cost the player (on average) betting $100 1.17−(−50.88)=$52,05. Thus, by making this mistake on a $100 bet (bet being synonymous with wager), this has (in the long run) cost the player $52.05!

TABLE II

| Player's Expected Return by Hitting | | | | | |
|---|---|---|---|---|---|
| PLAYER'S | DEALER'S UP CARD | | | | |
| HAND | 2 | 3 | 4 | 5 | 6 |
| 4 | −0.114913 | −0.082613 | −0.049367 | −0.012380 | 0.011130 |
| 5 | −0.128216 | −0.095310 | −0.061479 | −0.023979 | −0.001186 |
| 6 | −0.140759 | −0.107291 | −0.072917 | −0.034916 | −0.013006 |
| 7 | −0.109183 | −0.076583 | −0.043022 | −0.007271 | 0.029185 |
| 8 | −0.021798 | 0.008005 | 0.038784 | 0.070805 | 0.114960 |
| 9 | 0.074446 | 0.101265 | 0.128981 | 0.158032 | 0.196019 |
| 10 | 0.182500 | 0.206088 | 0.230470 | 0.256259 | 0.287795 |
| 11 | 0.238351 | 0.260325 | 0.283020 | 0.307350 | 0.333690 |
| 12 | −0.253390 | −0.233691 | −0.213537 | −0.193271 | −0.170526 |
| 13 | −0.307791 | −0.291210 | −0.274224 | −0.257333 | −0.235626 |
| 14 | −0.362192 | −0.348729 | −0.334911 | −0.321395 | −0.300726 |
| 15 | −0.416594 | −0.406249 | −0.395599 | −0.385457 | −0.365826 |
| 16 | −0.470995 | −0.463768 | −0.456286 | −0.449520 | −0.430927 |
| 17 | −0.536151 | −0.531674 | −0.527011 | −0.522986 | −0.508753 |
| 18 | −0.622439 | −0.620005 | −0.617462 | −0.615260 | −0.607479 |
| 19 | −0.729077 | −0.728033 | −0.726937 | −0.725991 | −0.722554 |
| 20 | −0.855230 | −0.854977 | −0.854710 | −0.854480 | −0.853628 |
| Soft 12 | 0.081836 | 0.103507 | 0.126596 | 0.156482 | 0.185954 |
| Soft 13 | 0.046636 | 0.074119 | 0.102477 | 0.133363 | 0.161693 |
| Soft 14 | 0.022392 | 0.050807 | 0.080081 | 0.111894 | 0.139165 |
| Soft 15 | −0.000121 | 0.029160 | 0.059285 | 0.091960 | 0.118246 |
| Soft 16 | −0.021025 | 0.009059 | 0.039975 | 0.073449 | 0.098821 |
| Soft 17 | −0.000491 | 0.028975 | 0.059326 | 0.091189 | 0.128052 |
| Soft 18 | 0.062905 | 0.090248 | 0.118502 | 0.147613 | 0.190753 |
| Soft 19 | 0.123958 | 0.149340 | 0.175577 | 0.202986 | 0.239799 |
| Soft 20 | 0.182500 | 0.206088 | 0.230470 | 0.256259 | 0.287795 |
| Soft 21 | 0.238351 | 0.260325 | 0.283020 | 0.307350 | 0.333690 |
| PLAYER'S | DEALER'S UP CARD | | | | |
| HAND | 7 | 8 | 9 | 10 | ACE |
| 4 | −0.088279 | −0.159334 | −0.240666 | −0.289198 | −0.253077 |
| 5 | −0.119447 | −0.188093 | −0.266615 | −0.313412 | −0.278575 |
| 6 | −0.151933 | −0.217242 | −0.292641 | −0.337749 | −0.304147 |
| 7 | −0.068808 | −0.210605 | −0.285365 | −0.319055 | −0.310072 |
| 8 | 0.082207 | −0.059898 | −0.210186 | −0.249375 | −0.197029 |
| 9 | 0.171868 | 0.098376 | −0.052178 | −0.152953 | −0.065681 |
| 10 | 0.256909 | 0.197954 | 0.116530 | 0.025309 | 0.081450 |
| 11 | 0.292147 | 0.229982 | 0.158257 | 0.119482 | 0.143001 |
| 12 | −0.212848 | −0.271575 | −0.340013 | −0.381043 | −0.350540 |
| 13 | −0.269073 | −0.323605 | −0.387155 | −0.425254 | −0.396930 |
| 14 | −0.321282 | −0.371919 | −0.430930 | −0.466307 | −0.440007 |
| 15 | −0.369762 | −0.416782 | −0.471578 | −0.504428 | −0.480006 |
| 16 | −0.414779 | −0.458440 | −0.509322 | −0.539826 | −0.517149 |
| 17 | −0.483486 | −0.505983 | −0.553695 | −0.584463 | −0.557300 |
| 18 | −0.591144 | −0.591056 | −0.616528 | −0.647671 | −0.626515 |
| 19 | −0.715450 | −0.713660 | −0.715574 | −0.729449 | −0.724795 |

TABLE II-continued

| Player's Expected Return by Hitting | | | | | |
|---|---|---|---|---|---|
| 20 | −0.851852 | −0.851492 | −0.850833 | −0.849029 | −0.852139 |
| Soft 12 | 0.165473 | 0.095115 | 0.000066 | −0.070002 | −0.020478 |
| Soft 13 | 0.122386 | 0.054057 | −0.037695 | −0.104851 | −0.057308 |
| Soft 14 | 0.079507 | 0.013277 | −0.075163 | −0.139467 | −0.093874 |
| Soft 15 | 0.037028 | −0.027055 | −0.112189 | −0.173704 | −0.130027 |
| Soft 16 | −0.004890 | −0.066795 | −0.148644 | −0.207441 | −0.165637 |
| Soft 17 | 0.053823 | −0.072915 | −0.149787 | −0.196867 | −0.179569 |
| Soft 18 | 0.170676 | 0.039677 | −0.100744 | −0.143808 | −0.092935 |
| Soft 19 | 0.220620 | 0.152270 | 0.007893 | −0.088096 | −0.005743 |
| Soft 20 | 0.256909 | 0.197954 | 0.116530 | 0.025309 | 0.081450 |
| Soft 21 | 0.292147 | 0.229982 | 0.158257 | 0.119482 | 0.143001 |

Table III below is a table showing the player expected returns for doubling on each initial hand. On the initial two cards dealt, the player has the option to double which means placing a bet equal (or less than equal) to the original bet and receive only one hit card.

TABLE III

| Player's Expected Return by Doubling | | | | | |
|---|---|---|---|---|---|
| PLAYER'S | DEALER'S UP CARD | | | | |
| HAND | 2 | 3 | 4 | 5 | 6 |
| Hard 4 | −0.585567 | −0.504500 | −0.422126 | −0.334385 | −0.307398 |
| Hard 5 | −0.585567 | −0.504500 | −0.422126 | −0.334385 | −0.307398 |
| Hard 6 | −0.564058 | −0.483726 | −0.402051 | −0.315577 | −0.281946 |
| Hard 7 | −0.435758 | −0.359779 | −0.282299 | −0.202730 | −0.138337 |
| Hard 8 | −0.204491 | −0.136216 | −0.066372 | 0.003456 | 0.087015 |
| Hard 9 | 0.061119 | 0.120816 | 0.181949 | 0.243057 | 0.317055 |
| Hard 10 | 0.358939 | 0.409321 | 0.460940 | 0.512517 | 0.575590 |
| Hard 11 | 0.470641 | 0.517795 | 0.566041 | 0.614699 | 0.667380 |
| Hard 12 | −0.506780 | −0.467382 | −0.427073 | −0.386542 | −0.341052 |
| Hard 13 | −0.615582 | −0.582420 | −0.548448 | −0.514667 | −0.471253 |
| Hard 14 | −0.724385 | −0.697459 | −0.669823 | −0.642791 | −0.601453 |
| Hard 15 | −0.833187 | −0.812497 | −0.791198 | −0.770915 | −0.731653 |
| Hard 16 | −0.941990 | −0.927536 | −0.912573 | −0.899039 | −0.861853 |
| Hard 17 | −1.072302 | −1.063348 | −1.054023 | −1.045971 | −1.017505 |
| Hard 18 | −1.244877 | −1.240010 | −1.234924 | −1.230519 | −1.214958 |
| Hard 19 | −1.458155 | −1.156066 | −1.453874 | −1.451983 | −1.445108 |
| Hard 20 | −1.710461 | −1.709954 | −1.709420 | −1.708961 | −1.707256 |
| Soft 12 | −0.071570 | −0.007228 | 0.058427 | 0.125954 | 0.179748 |
| Soft 13 | −0.071570 | −0.007228 | 0.058427 | 0.125954 | 0.179748 |
| Soft 14 | −0.071570 | −0.007228 | 0.058427 | 0.125954 | 0.179748 |
| Soft 15 | −0.071.570 | −0.007228 | 0.058427 | 0.125954 | 0.179748 |
| Soft 16 | −0.071570 | −0.007228 | 0.058427 | 0.125954 | 0.179748 |
| Soft 17 | −0.007043 | 0.055095 | 0.118653 | 0.182378 | 0.256104 |
| Soft 18 | 0.119750 | 0.177641 | 0.237004 | 0.295225 | 0.381506 |
| Soft 19 | 0.241855 | 0.295824 | 0.351154 | 0.405972 | 0.479599 |
| Soft 20 | 0.358939 | 0.409321 | 0.460940 | 0.512517 | 0.575590 |
| Soft 21 | 0.470641 | 0.517795 | 0.566041 | 0.614699 | 0.667380 |
| PLAYER'S | DEALER'S UP CARD | | | | |
| HAND | 7 | 8 | 9 | 10 | ACE |
| Hard 4 | −0.950750 | −1.021035 | −1.086299 | −1.080861 | −1.333902 |
| Hard 5 | −0.950750 | −1.021035 | −1.086299 | −1.080861 | −1.333902 |
| Hard 6 | −0.894048 | −1.001256 | −1.067839 | −1.062290 | −1.304837 |
| Hard 7 | −0.589336 | −0.847076 | −0.957074 | −0.950866 | −1.130452 |
| Hard 8 | −0.187730 | −0.451987 | −0.718501 | −0.746588 | −0.810746 |
| Hard 9 | 0.104250 | −0.026442 | −0.300996 | −0.466707 | −0.432911 |
| Hard 10 | 0.392412 | 0.286636 | 0.144328 | −0.008659 | −0.014042 |
| Hard 11 | 0.462889 | 0.350693 | 0.227783 | 0.179689 | 0.109061 |
| Hard 12 | −0.506712 | −0.615661 | −0.737506 | −0.796841 | −0.829344 |
| Hard 13 | −0.587423 | −0.690966 | −0.807790 | −0.867544 | −0.880582 |
| Hard 14 | −0.668135 | −0.766271 | −0.878075 | −0.938247 | −0.931821 |
| Hard 15 | −0.748846 | −0.841576 | −0.948360 | −1.008950 | −0.983059 |
| Hard 16 | −0.829558 | −0.916881 | −1.018644 | −1.079653 | −1.034297 |
| Hard 17 | −0.966972 | −1.011965 | −1.107390 | −1.168926 | −1.114600 |
| Hard 18 | −1.182288 | −1.182112 | −1.233057 | −1.295342 | −1.253031 |
| Hard 19 | −1.430899 | −1.427320 | −1.431149 | −1.458898 | −1.449590 |
| Hard 20 | −1.703704 | −1.702984 | −1.701665 | −1.698058 | −1.704278 |

TABLE III-continued

| Player's Expected Return by Doubling | | | | | |
|---|---|---|---|---|---|
| Soft 12 | −0.183866 | −0.314441 | −0.456367 | −0.514028 | −0.624391 |
| Soft 13 | −0.183866 | −0.314441 | −0.456367 | −0.514028 | −0.624391 |
| Soft 14 | −0.183866 | −0.314441 | −0.456367 | −0.514028 | −0.624391 |
| Soft 15 | −0.183866 | −0.314441 | −0.456367 | −0.514028 | −0.624391 |
| Soft 16 | −0.183866 | −0.314441 | −0.456367 | −0.514028 | −0.624391 |
| Soft 17 | −0.013758 | −0.255102 | −0.400984 | −0.458316 | −0.537198 |
| Soft 18 | 0.219948 | −0.029917 | −0.290219 | −0.346892 | −0.362813 |
| Soft 19 | 0.319835 | 0.195269 | −0.072946 | −0.235468 | −0.188428 |
| Soft 20 | 0.392412 | 0.286636 | 0.144328 | −0.008659 | −0.014042 |
| Soft 21 | 0.462889 | 0.350693 | 0.227783 | 0.179689 | 0.109061 |

Table IV below is a table showing the player's expected returns for splitting each possible initial hand. If the player's initial two cards are the same rank, the player can place an additional wager equal to the original wager and split the two cards into completely separate hands.

TABLE IV

| Player's Expected Return by Splitting | | | | | |
|---|---|---|---|---|---|
| PLAYER'S | DEALER'S UP CARD | | | | |
| HAND | 2 | 3 | 4 | 5 | 6 |
| 2,2 | −0.084336 | −0.015650 | 0.059088 | 0.151665 | 0.226890 |
| 3,3 | −0.137710 | −0.056273 | 0.029932 | 0.126284 | 0.201318 |
| 4,4 | −0.192325 | −0.108712 | −0.020395 | 0.081913 | 0.151377 |
| 5,5 | −0.290154 | −0.208718 | −0.119335 | −0.019231 | 0.045404 |
| 6,6 | −0.212560 | −0.119715 | −0.021320 | 0.080912 | 0.153668 |
| 7,7 | −0.131478 | −0.043733 | 0.049255 | 0.146678 | 0.247385 |
| 8,8 | 0.073852 | 0.146187 | 0.220849 | 0.297475 | 0.409329 |
| 9,9 | 0.195625 | 0.258548 | 0.323474 | 0.391987 | 0.471339 |
| 10,10 | 0.134774 | 0.212836 | 0.293403 | 0.380367 | 0.468117 |
| A,A | 0.470641 | 0.517795 | 0.566041 | 0.614699 | 0.667380 |
| PLAYER'S | DEALER'S UP CARD | | | | |
| HAND | 7 | 8 | 9 | 10 | ACE |
| 2,2 | 0.006743 | −0.176693 | −0.386883 | −0.507175 | −0.433570 |
| 3,3 | −0.053043 | −0.231843 | −0.436607 | −0.553507 | −0.482405 |
| 4,4 | −0.166452 | −0.326068 | −0.511152 | −0.625044 | −0.560206 |
| 5,5 | −0.293928 | −0.454237 | −0.634113 | 0.729969 | −0.668811 |
| 6,6 | −0.264427 | −0.425122 | −0.610576 | −0.716103 | −0.653362 |
| 7,7 | −0.050148 | −0.391981 | −0.577584 | −0.657268 | −0.651641 |
| 8,8 | 0.321042 | −0.022736 | −0.387228 | −0.480686 | −0.372535 |
| 9,9 | 0.364837 | 0.234447 | −0.078010 | −0.317336 | −0.136810 |
| 10,10 | 0.296633 | 0.064443 | −0.206733 | −0.371278 | −0.249494 |
| A,A | 0.462889 | 0.350693 | 0.227783 | 0.179689 | 0.109061 |

Thus, from Tables I, II, III, and IV, it can be seen that there is always a correct play at every player decision point. Incorrect plays end up costing the player money in expected value (although of course if the player gets lucky he may fare better from an incorrect play). That data in Tables I, II, III, and IV can be determined by running millions of Monte Carlo simulations, tabulating and storing the results. Note that all of the data in these Tables are generated for a standard game of blackjack with the following rules: dealer stands on soft 17, an infinite deck is used, player may double after a split, the player may split up to three times (but not aces where the player only gets one card on each split ace). It can be appreciated that blackjack can be played with a variety of rules and the expected returns would have to be specifically computed for the particular variant of blackjack being offered.

In an embodiment, the errors that a player makes while playing blackjack can be given back to the player in order to compensate the player for these mistakes. This may be helpful for beginners who are learning the game but can be applied to players of all skill levels.

Figure 7:
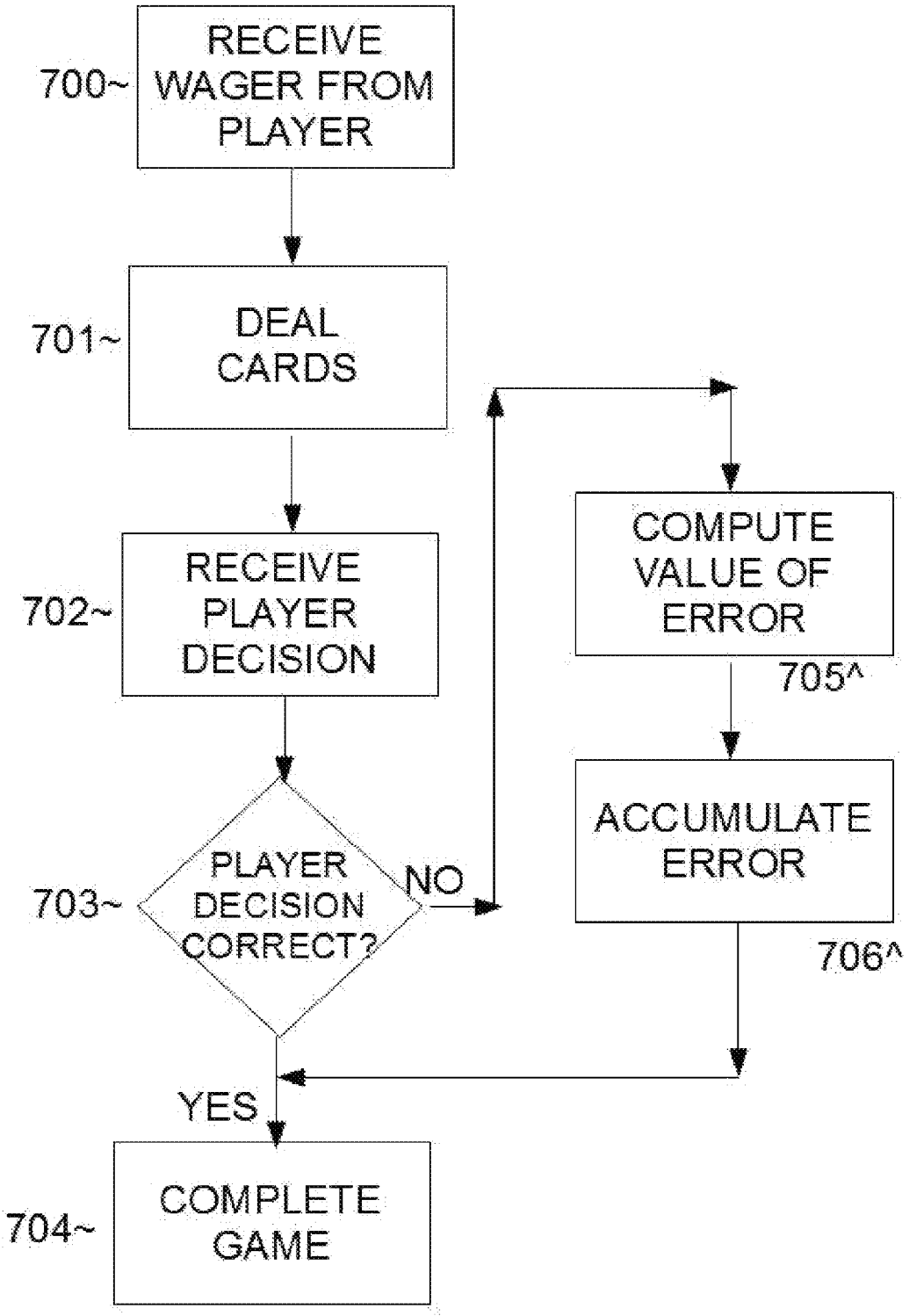
FIG. 7 is a flowchart illustrating a method to accumulate values of player decision errors, according to an embodiment.

FIG. 7 is a flowchart illustrating a method to accumulate values of player decision errors, according to an embodiment.

The method can begin with operation 700, in which the player places their wager (typically in the form of non cash value chips).

The method proceeds to operation 701, which deals the cards to the player and the dealer. The cards are selected randomly using an electronic random number generator.

From operation 701, the method proceeds to operation 702 which receives the player decision (e.g., hit, stand, and if applicable, double or split). The player indicates his/her decision by clicking respective buttons on the screen.

From operation 702, the method proceeds to operation 703 which determines whether the player's decision was correct or not. A correct decision is the one that has the highest expected value out of all of the possible decisions at that point in the game. If the player made the correct decision, then the method proceeds to operation 704, which completes the game. The game can be implemented as illustrated and described with regard to FIG. 1. Any winnings are added to the player's credit meter. All amounts of non-cash value chips and loyalty points are stored in the player's account so when the player returns to the game at a later time his/her current chips and points are all restored from the previous session.

If in operation 703, the player's decision is not correct, then the method proceeds to operation 705 which computes the value of the error. The value of the error is computed by first determining the expected value of the best play. This can be done by retrieving the expected value of all of the possible options (options which are not possible at the time, such as doubling after the initial two cards or splitting unlike cards are not considered) and the one with the highest expected value for the player is the best play. This can be done using a set of tables such as Tables I, II, III, IV. Once the expected value for the best play is determined, then the expected value of the actual play is subtracted from. The result is the cost of the error in player return. This cost of the error in player return is then multiplied by the original wager amount in order to determine the theoretical cost of the error. The following formula can be used, where C is the actual theoretical cost of the error (referred to as the value of error in FIG. 7).

$$C=(\text{expected value of best play}-\text{expected value of actual play})*bet\ \text{amount}$$

Thus, for example, if the player bets $5 and makes a play that has an expected value of 0.20 and the best (or optimal) play has an expected value of 0.30, then the difference (0.10) multiplied by $5 is $0.50 which represents the theoretical cost to the player. In a real casino, the casino would profit from these errors that the player would make. When the player is playing with non cash value chips, it does not directly cost the casino anything to compensate the player for these errors and hence the method illustrated in FIG. 7 can be implemented. Note that while the player could have made a theoretical error, in reality the player could have actually won by making the mistake. Computing and returning C to the player does not care about the actual result from each play, only the theoretical loss.

From operation 705, the method proceeds to operation 706, which accumulates the error. The error for each player can be accumulated (added to a running total which is stored in the player's account) each time operation 706 occurs and at a certain point in time the entire accumulated error can then be returned to the player. One way it can be returned to the player is the accumulated error can simply be added to the player's non-cash value chips (credit meter) and then the accumulated error is reset to zero. In another embodiment, each time there is an error it is immediately returned to the player by adding the error (C) back to the player's credit meter.

In a further embodiment, C can be multiplied by a constant before returning it to the player as non-cash value chips to soften the errors the player made but not completely adjust for them. For example, C can be multiplied by 0.80 and then the result is added to the player's credit meter (as non-cash value chips), thereby giving the player 80% of his/her error back. This still encourages the player to play correctly but softens the blow of the errors.

From operation 706, the method can proceed to operation 704 which continues and completes the game according to blackjack rules (see FIG. 1).

Note that errors can occur not only on the initial decision (after the first two cards are dealt to the player) but at later decision points in the game as well. For example, if the player is dealt initial two cards of 4 and 6 (total 10) and the dealer's up-card is 10, and the player hits and receives a 5 (player point total of 15), then the proper play for the dealer would be to hit again (hitting 15 vs. 10) but if the player stands (a common error) then this error (C) will also be computed using the methods herein and treated accordingly. Any such decision by the player in the game is subject to the error computation and reimbursement of an amount of credits based on the value of the error.

In an embodiment, operation 703 is modified such that it determines whether the player did not make the worst decision. If the player did not make the worst decision (yes) then the method proceeds to operation 704. If the answer to whether the player did not make the worst decision is negative (i.e. the player made the worst decision0 then the method proceeds to operation 705. Thus, in this embodiment, the error is accumulated only when the player makes the worst decision. There can be multiple decisions (e.g., hit, stand, double) and only when the player makes the worst decision (with the lowest expected player return) does the player get reimbursed for his/her error. Otherwise, if the player does not make the play with the lowest expected player return, then the game plays normally without any compensation due to the player.

In a further embodiment, error is only accumulated (operations 705-706) if an additional wager was made for the decision in operation 702. Additional wagers can be made in blackjack during doubling, splitting, and taking insurance. Only if the player makes one of these decisions (which requires an additional bet) will the error then be accumulated if that decision was wrong. This can be represented in FIG. 7 by adding a decision between operations 702 and 703 which determines whether the player decision from operation 702 also received an additional wager. If it did receive an additional wager, then the method proceeds to operation 703 and if it did not receive an additional wager then the method proceeds to operation 704. In this way, the only errors that are accumulated are errors when the player decides to double, split, or take insurance. Taking insurance is always the mathematically incorrect play anyway and so the player would receive a compensation (operations 705-706) for this mistake. In a further variant if this embodiment, the error of taking insurance would not trigger the accumulation of error and would proceeds to operation 704.

Figure 8:
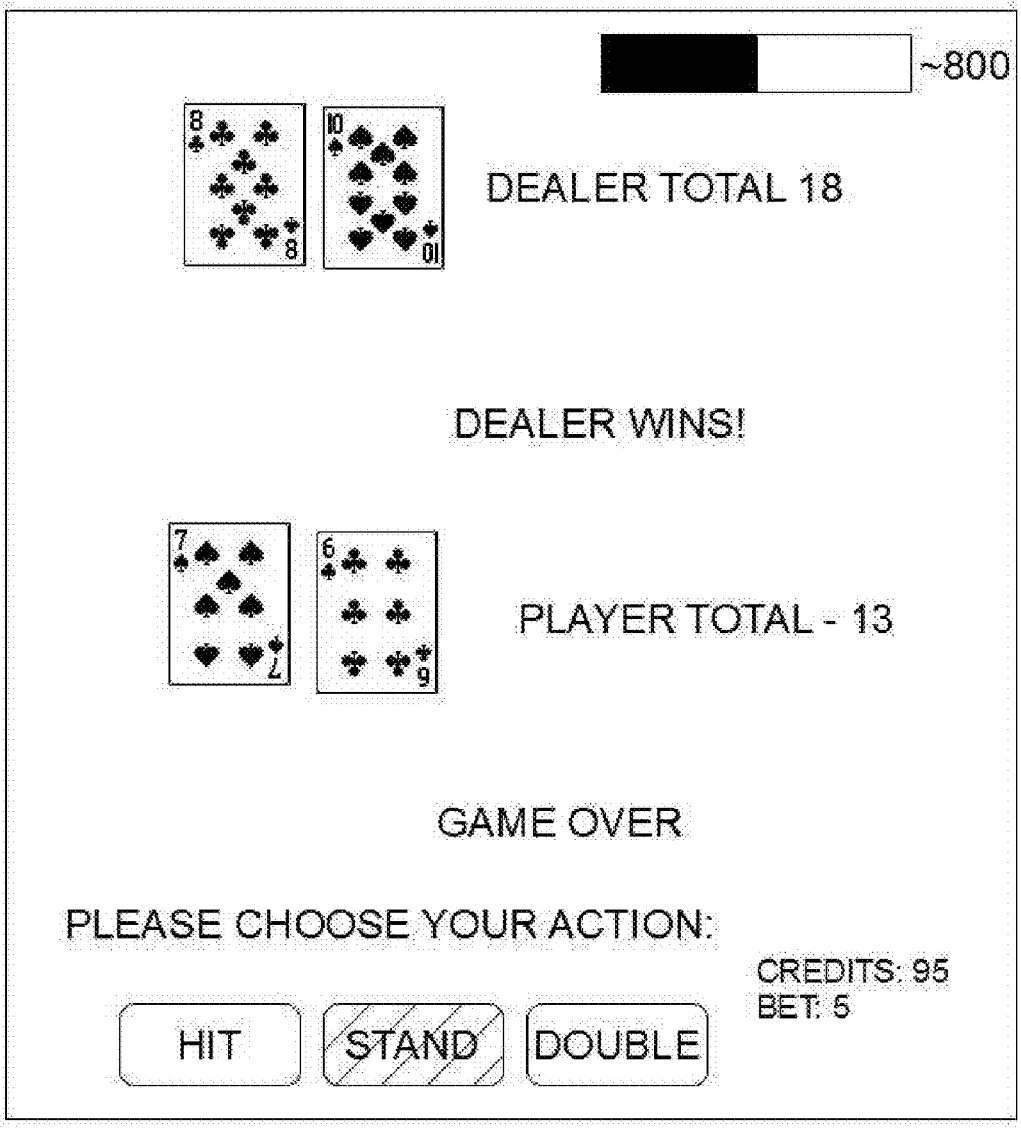
FIG. 8 is a drawing of a game illustrating an error meter, according to an embodiment.

FIG. 8 is a drawing of a game illustrating an error meter, according to an embodiment.

During play of the game, an error meter 800 can fill in each time the player makes an error. When the error meter 800 is completely filled in, the accumulated errors (sum of all of the computed Cs) will then be added to the player's credit meter (e.g., non-cash value credits) and the meter will be reset. Optionally, the amount added to the player's credit meter can be multiplied by a constant (e.g., 0.8) to reduce the amount of a refund the player gets (as described herein).

In one embodiment, the error meter 800 represents the number of errors and each error the player commits the error meter 800 will fill in an equal amount. For example, the error meter can represent 10 errors, and each error the error meter 800 will fill in 10% and upon 10 errors the error meter 800 will be completely filled which will trigger a reset of the error meter and the award of the accumulated error to the player. The actual amount of the errors are not reflected in the error meter. Thus, after a predetermined number of errors occurs then the accumulate error (sum of all error values C) is awarded. The predetermined number of errors can be any value, such as 2-10 or more.

In another embodiment, the amount that is filled in the error meter (filled in refers to the black portion of the error meter 800) is proportional to the actual amount of C (the theoretical error committed). For example, the error meter 800 can represent 100 represent credits of error and can have a capacity of 100 credits. If the player made an error where C is 25 credits then the error meter 800 will fill in 25% more. When the accumulated error surpasses the capacity of the capacity of the error meter 800 then this will trigger the award of the accumulated error to the player (adding it to the player's credit meter as described herein) and a reset of the meter. Thus, only after the player accumulates 100 credits worth (or any other number) of errors would the trigger be satisfied and the accumulated award would be distributed to the player (in any manner described herein) and the error meter 800 would be reset back to 0.

In one embodiment, the error meter is displayed to the player during play of the game. In another embodiment, the error meter is not displayed to the player. In one embodiment, when the accumulated error is awarded to the player a message to that effect is displayed to the player such as "you have made 8 errors equivalent to 125 credits today, this amount is being credited back to your credit meter." In another embodiment, no such message is displayed to the player and the credit meter is simply increased. In another embodiment, no such message is displayed to the player and the accumulated error is given back to the player in the form of a predetermined result (e.g., a spin on a wheel which is not random but predetermined to result in the amount of the accumulated error).

Note that all features described herein can be applied to any variation of blackjack. For example, games like FREE BET blackjack, BLACKJACK SWITCH, and any other such variation.

Note that all of the methods herein can be applied to a networked server system which can accommodate a large number of players simultaneously. For example 10 (or more) players can be playing on their own computers (or portable devices) at different locations throughout the country and they all view only their own game but not games of the other players. The methods described herein are implemented simultaneously for all of the players playing simultaneously.

Figure 9A:
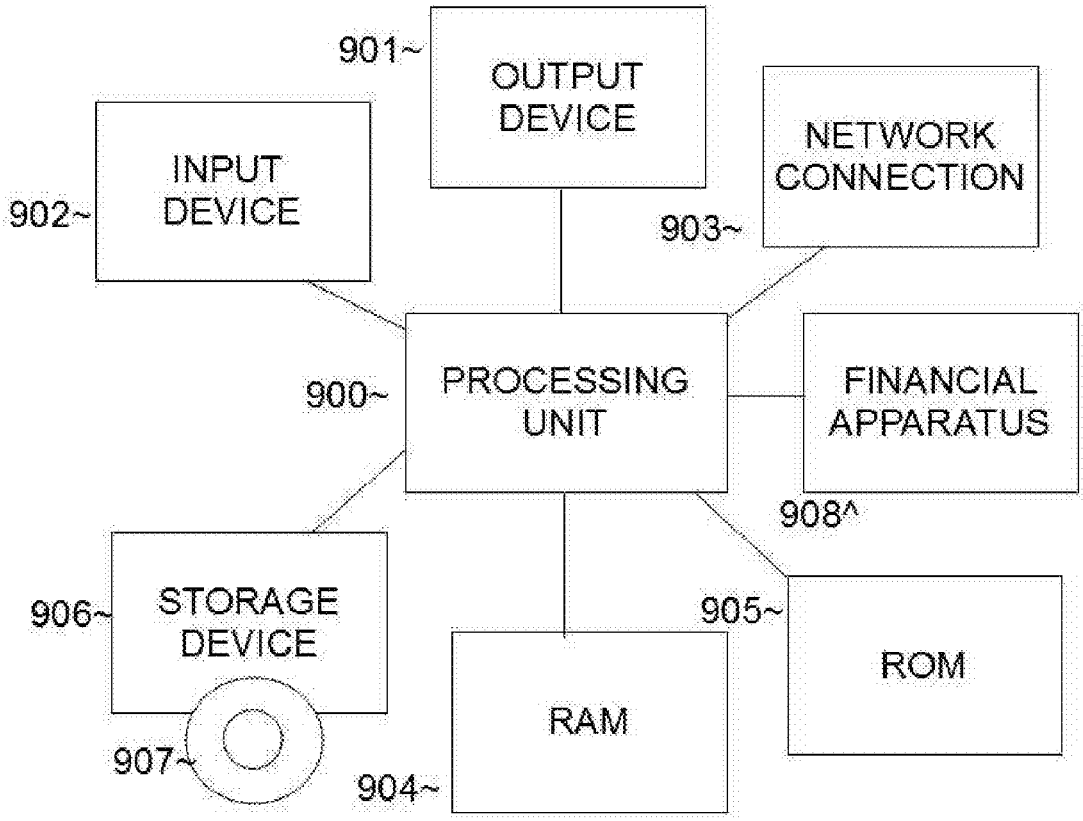
FIG. 9A is a block diagram illustrating exemplary hardware that can be used to implement the game described herein, according to an embodiment.

FIG. 9A is a block diagram illustrating exemplary hardware that can be used to implement the game described herein, according to an embodiment. The hardware in FIG. 5A can be used to implement a computer implementing the game described herein and/or a server that is serving the game to a computer which is displaying the game to a player. Such a server can interface with a social networking site (e.g., FACEBOOK, MYSPACE, etc.) that is used to coordinate the entire game and communicate with the players as well as a server used by the social network site.

A processing unit 900 can be a microprocessor (or more than one microprocessor working together) and associated structure (e.g., bus, cache, clock, etc.) which can be connected to an input device (e.g., touch-screen, keyboard, mouse, buttons, etc.), and an output device (e.g., touch-screen, CRT, monitor, etc.) The processing unit 900 can implement any of the methods described herein. The processing unit 900 can also be connected to a network connection 903 which can connect to a computer communications network such as the Internet, Wi-Fi, LAN, WAN, etc. The processing unit 900 can also be connected to a ROM 904 and a RAM 905 as used in the art. The processing unit 900 can also be connected to a storage device 906 which can be nonvolatile storage device (e.g., BLU-RAY drive, CD-ROM drive, hard drive, EPROM, etc.) A non-transitory computer readable medium 907 (e.g., BLU-RAY disc, CD-ROM, hard disc, etc.) can be read by the storage device 906 and can store programs and assets that can cause the processing unit 900 to perform any of the methods described herein. The ROM and RAM can also be loaded with instructions that can cause the processing unit 900 to perform any of the methods described herein.

Figure 9B:
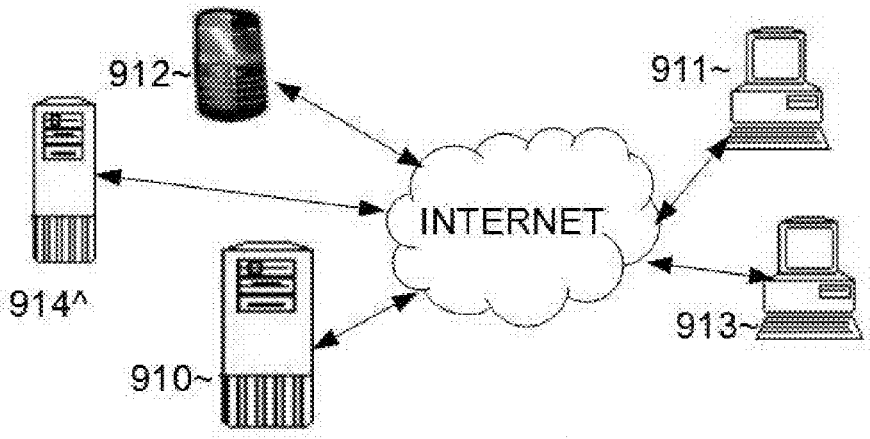
FIG. 9B is a network diagram showing a network structure for a social networking web site and players, according to an embodiment.

FIG. 9B is a network diagram showing a network structure for a social networking web site and players, according to an embodiment. The online game which awards and stores loyalty points can also be accomplished by the system illustrated in FIG. 9B.

A computer communications network (such as the Internet) can be used to connect a host server 910 which can host and serve a social networking site. Note that while FIG. 9B shows only one server as the host server 910, the host server 910 can encompass numerous servers all cooperating with each other (whether in the same physical location or not). The host server 910 communicates with players 911, 912, 913 through the Internet (or other computer communication network) who are all at different physical locations and can implement any of the methods herein by executing computer code programmed accordingly. While only three players are shown, any number of players (e.g., 1, 2, 3, 5, 10, 20, 1-1000, or more) can participate in the methods described herein simultaneously (e.g., all such players are served and can play the game (and any methods herein) at the same time) even though the players can be in different physical locations via the Internet. For example at least 10 players (or any other number) are in remote communication with the host server 910 simultaneously even though these players are located all over the country (or even in foreign countries).

Game server 914 can also implement all games and methods described herein on the site by executing computer code programmed accordingly. The game server 914 is connected to the Internet and can communicate with all of the players 911, 912, 913 directly or indirectly through the social networking site hosted by the host server 910. The game server 914 can cooperate with the host server 910 so that the games run on the game server 914 can be integrated into the social networking site hosted by the host server 910. The game server can also be optional and all of the games can be also hosted on the host server 910, whereby the integration of the games served/hosted by the game server 914 will appear embedded in the social networking site hosted by the host server 910 such that players would typically not realize (or care) that multiple servers are cooperating in order to play games on the social networking site. All of the communications described herein can be effectuated using such a network configuration. Typically, the communications are effectuated on the social networking site itself, thus the players 911, 912, 913 should be logged into the social networking site in order to participate herein, although logging in is not required (e.g., communications can be transmitted using other methods, such as email, IRC chat, instant message, etc.) The host server 910 can communicate with any of the devices described herein.

All components herein can be distributed across different such components as needed. For example, a single server as mentioned herein can be distributed across numerous different servers and locations. A processor (or processing unit) can also be distributed across multiple processors in a same or different computer (at a same or different location). The electronic components described herein represent an abstraction but it can be appreciated that the computer systems implementing the methods herein can be more numerous and interconnected than illustrated herein.

If a player is playing the game described herein on a social networking site or other type of hosted environment, then the player's computer would cooperate with the social networking server in order to present the game to the player. The player's computer would perform the instructions necessary to display the game while the remote server can determine the results (e.g., the final arrangement) and communicate this result via the Internet to the player's computer so that the player's computer can accurately display the result. The remote server may track and account for all credits wagered and won/lost while the player's computer can display the amount of credits owned or won at the direction of the remote server so the player cannot tamper with these amounts. All games described herein are considered to be played on the site described herein.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All features described herein (including all documents incorporated by reference) can be combined with one another without limitation. While the "credits" are used herein to refer to awards provided to players typically refers to non-cash value credits, this can also refer to cash credits as well (that are directly redeemable for cash).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to implement a game, the method comprising:

performing the following operations on at least one electronic server each of which comprises at least electronic processing unit:

for a plurality of players comprising at least ten players at remote and different locations physical locations;

establishing a network connection with each of the plurality of players, and for each respective player of the plurality of players:

receiving a wager of credits from the respective player;

displaying to the player on an output device associated with the respective player a set of two randomly selected player cards and one dealer randomly selected dealer card face up;

receiving from the respective player a decision;

upon the decision not being a correct decision, determining an error value which is a theoretical value of an error associated with the decision;

accumulating the error value as accumulated error for the respective player;

upon a trigger occurring, converting the accumulated error into credits; and increasing the respective player's credit meter based on the accumulated error.

2. The method as recited in claim 1, wherein the error value is computed by determining (an expected value of the correct play–an expected value of the decision made by the player)*an amount of the wager.

3. The method as recited in claim 1, wherein the increasing the respective player's credit meter increases the respective player's credit meter by the error value multiplied by a constant for each error.

4. The method as recited in claim 1, wherein the trigger is upon each error made.

5. The method as recited in claim 1, wherein the trigger occurs after a predetermined number of errors has occurred.

6. The method as recited in claim 5, wherein an error meter is displayed which displays a meter to the respective player illustrating a current amount of errors.

7. The method as recited in claim 1, wherein the trigger occurs after a predetermined amount of accumulated error has occurred.

8. The method as recited in claim 7, wherein an error meter is displayed which displays a meter to the respective player illustrating a current amount of accumulated error.

9. The method as recited in claim 1, wherein the credits are non cash value credits.

10. The method as recited in claim 1, wherein a table of stored in computer memory of all expected values of all potential decisions by the player which is used to determine the error value.

11. An apparatus to implement a game, the method comprising:

one or more electronic servers, each server comprising at least one electronic processor;

a network connection connected to the one or more electronic servers connecting the one or more electronic servers to the Internet;

a non-transitory computer readable storage unit connected to the one or more electronic servers, the storage unit storing computer readable instructions that when executed cause the one or more electronic servers to perform, for each of a plurality of players comprising least 10 players locations at remote and different locations physical locations:

establish a network connection with each respective player;

receive a wager of credits from the respective player;

display to the player on an output device associated with the respective player a set of two randomly selected player cards and one dealer randomly selected dealer card face up;

receive from the respective player a decision;

upon the decision not being a correct decision, determining an error value which is a theoretical value of an error associated with the decision;

accumulate the error value as accumulated error for the respective player;

upon a trigger occurring, convert the accumulated error into credits; and increase the respective player's credit meter based on the accumulated error.

12. The apparatus as recited in claim 11, wherein the computer readable instructions are further programmed such the error value is computed by determining (an expected value of the correct play–an expected value of the decision made by the player)*an amount of the wager.

13. The apparatus as recited in claim 11, wherein the computer readable instructions are further programmed such the increasing the respective player's credit meter increases the respective player's credit meter by the error value multiplied by a constant for each error.

14. The apparatus as recited in claim 11, wherein the computer readable instructions are further programmed such the trigger is upon each error made.

15. The apparatus as recited in claim 11, wherein the computer readable instructions are further programmed such the trigger occurs after a predetermined number of errors has occurred.

16. The apparatus as recited in claim 15, wherein the computer readable instructions are further programmed such an error meter is displayed which displays a meter to the respective player illustrating a current amount of errors.

17. The apparatus as recited in claim 11, wherein the computer readable instructions are further programmed such the trigger occurs after a predetermined amount of accumulated error has occurred.

18. The apparatus as recited in claim 17, wherein the computer readable instructions are further programmed such an error meter is displayed which displays a meter to the respective player illustrating a current amount of accumulated error.

19. The apparatus as recited in claim 11, wherein the computer readable instructions are further programmed such the credits are non cash value credits.

20. The apparatus as recited in claim 11, wherein the computer readable instructions are further programmed such a table of stored in computer memory of all expected values of all potential decisions by the player which is used to determine the error value.

* * * * *